US006183331B1

(12) United States Patent
Lai

(10) Patent No.: US 6,183,331 B1
(45) Date of Patent: Feb. 6, 2001

(54) ASSEMBLING STRUCTURE FOR LANDING GEAR OF A MODEL AIRPLANE

(75) Inventor: Aling Lai, Taichung (TW)

(73) Assignee: Thunder Tiger Corporation, Taichung (TW)

( * ) Notice: Under 35 U.S.C. 154(b), the term of this patent shall be extended for 0 days.

(21) Appl. No.: 09/395,338

(22) Filed: Sep. 13, 1999

(51) Int. Cl.[7] ..... A63H 27/00; A41F 1/00
(52) U.S. Cl. ..... 446/34; 446/55; 24/596
(58) Field of Search ..... 24/596, 597, 591; 446/30, 34, 55, 57, 61

(56) References Cited

U.S. PATENT DOCUMENTS 1,428,916 * 9/1922 Snideman ..... 24/596
2,347,689 * 5/1944 Johnson ..... 446/57
2,401,459 * 6/1946 Cavanaugh ..... 446/30
2,643,126 * 6/1953 Kelly ..... 446/30 X
2,956,029 * 4/1934 Holmes ..... 24/596
3,422,567 * 1/1969 Farb et al. ..... 446/55
4,801,232 * 1/1989 Hempel ..... 24/596
5,078,638 * 1/1992 Molina ..... 446/57
5,361,925 * 11/1994 Wecke et al. ..... 24/596

* cited by examiner

*Primary Examiner*—D. Neal Muir
(74) *Attorney, Agent, or Firm*—Rosenberg , Klein & Lee

(57) ABSTRACT

An assembling structure for landing gear of a model airplane, including an airplane body having a base board on which a landing gear fixing seat mounted. The landing gear is fixed on the fixing seat by fixing pins passing through the fixing seat. The cap section of the fixing pin can be rotated by 90 degrees to engage in a channel of the fixing section of the landing gear. Under such circumstance, the landing gear is disengaged from the cap section of the fixing pin and can be quickly disassembled from the fixing seat and separated from the airplane body. Accordingly, the model airplane body and the landing gear can be quickly assembled and disassembled to facilitate carriage and storage of the model airplane.

5 Claims, 4 Drawing Sheets

ASSEMBLING STRUCTURE FOR LANDING GEAR OF A MODEL AIRPLANE

BACKGROUND OF THE INVENTION

The present invention relates to an assembling structure for landing gear of a model airplane, which permits the model airplane body and the landing gear to be quickly assembled and disassembled.

FIG. 4 shows a conventional fixing structure for landing gear of a model airplane. Self-tightening screws 91 are passed through the fixing holes 921 of the landing gear 92 and screwed into the base board 90 of the airplane body so as to fix the landing gear 92 on the base board 90.

The base board 90 is made of relatively light wooden material with low density. Therefore, it is unsuitable for a user to repeatedly tighten the base board 90 with the self-tightening screws 91. Otherwise, the thread will be damaged and it will be impossible to further tighten the self-tightening screws 91. Therefore, it is unsuitable to disassemble the landing gear 92 once it is fixed by the self-tightening screws 91. This leads to inconvenience in storage and carriage of the model airplane.

SUMMARY OF THE INVENTION

It is therefore a primary object of the present invention to provide an assembling structure for landing gear of a model airplane, in which the landing gear is fixed on a landing gear fixing seat by fixing pins passing through the fixing seat. The cap section of the fixing pin can be rotated by 90 degrees to engage in a channel of a fixing section of the landing gear. Under such circumstance, the landing gear is disengaged from the cap section of the fixing pin and can be quickly disassembled from the fixing seat and separated from the airplane body. Accordingly, the model airplane body and the landing gear can be quickly assembled and disassembled to facilitate carriage and storage of the model airplane.

According to the above object, the assembling structure for landing gear of a model airplane of the present invention includes:

- a hollow airplane body having a base board formed with a recess;
- a landing gear fixing seat mounted in the recess of the airplanebody and having a left and a right circular through holes; and
- a landing gear fixed on the fixing seat by fixing pins, the landing gear having a fixing section formed with two elongated fixing holes corresponding to the through holes of the fixing seat, a bottom face of the fixing section being formed with a channel perpendicular to each fixing hole.

One end of the fixing pin is formed with a cap section having a profile corresponding to that of the fixing hole. The cap section extends out of the fixing hole. A top face of the cap section is formed with a rib having a profile corresponding to that of the channel. One end of the fixing pin opposite to the cap section is formed with an engaging section. The end of the fixing pin with the engaging section is passed through the through hole of the fixing seat. A resilient member is fitted between the engaging section and a top face of the fixing seat. An upper and a lower edges of the resilient member respectively abut against the engaging section of the fixing pin and the top face of the fixing seat.

The present invention can be best understood through the following description and accompanying drawings wherein:

DETAILED DESCRIPTION OF THE PREFERRED EMBODIMENT

Figure 1:
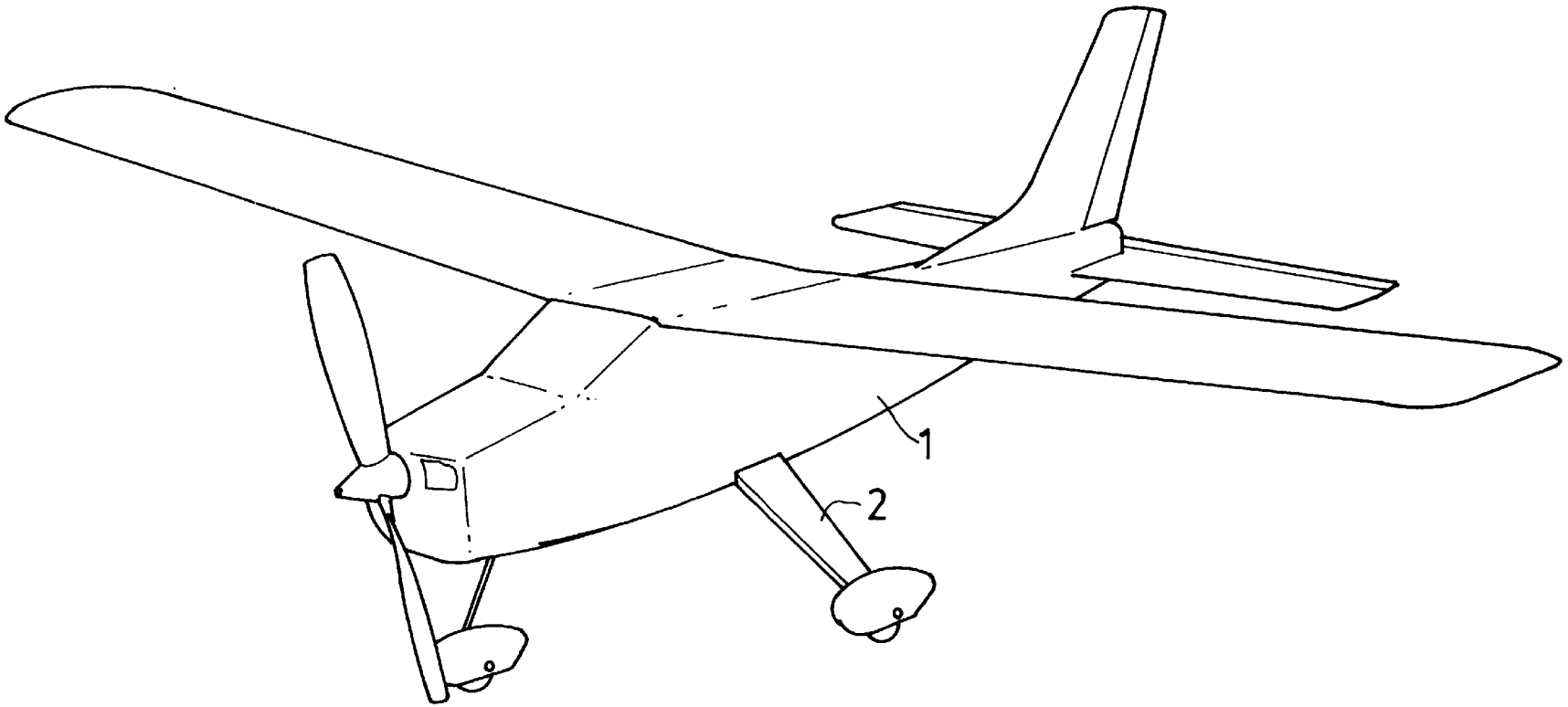
FIG. 1 is a perspective view showing the appearance of the present invention.
Figure 2:
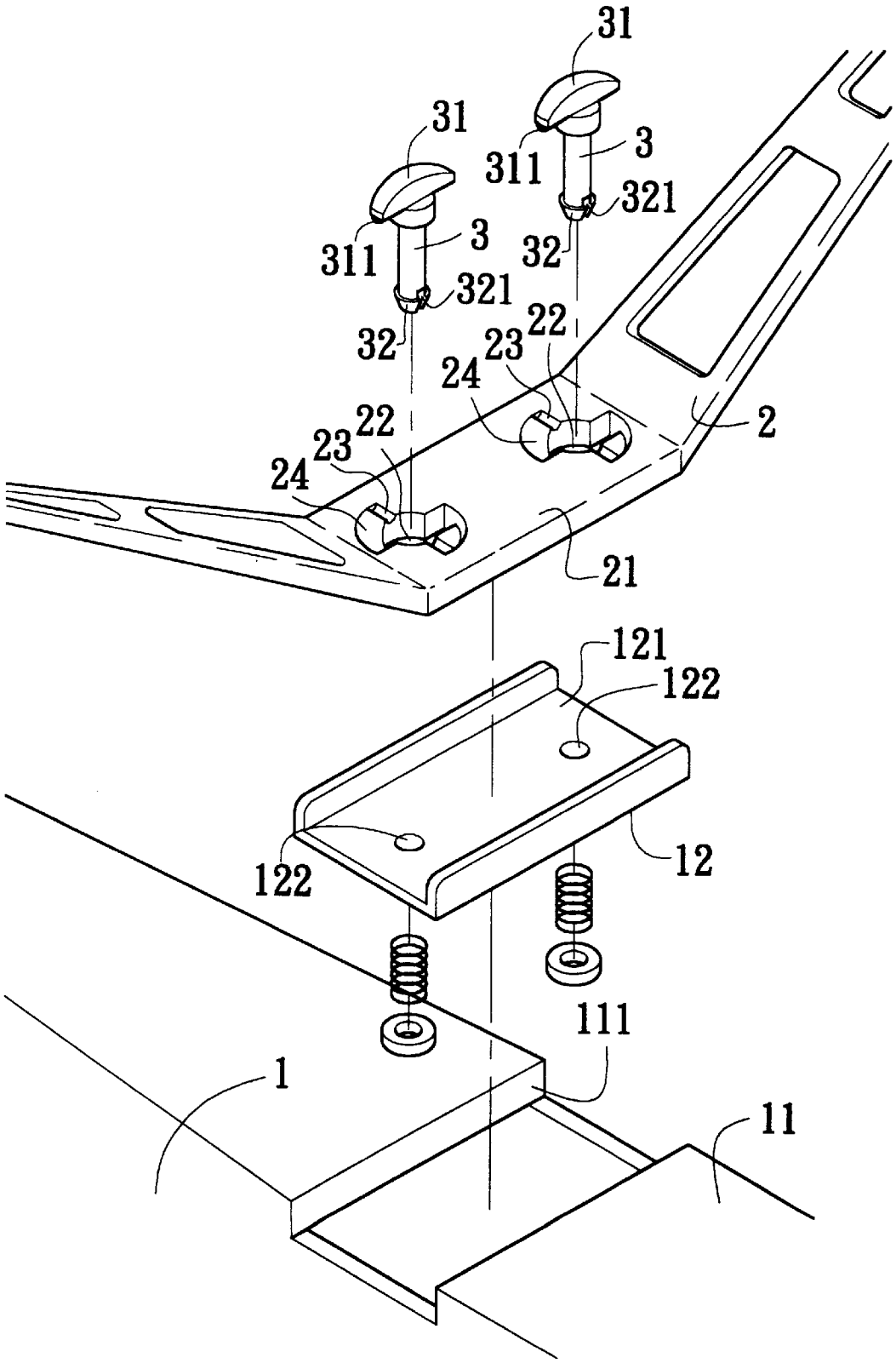
FIG. 2 is a perspective exploded view of the landing gear and the airplane body of the present invention.

Please refer to FIGS. 1 and 2. The assembling structure for landing gear of the model airplane of the present invention includes a hollow airplane body I having a base board 11 formed with a recess 111 for mounting a landing gear fixing seat 12.

The landing gear fixing seat 12 is made of hard wooden material or plastic material, having a locating section 121 on which a landing gear 2 is mounted by fixing pins 3. The locating section 121 serves to stop the front and rear edges of the landing gear 2. The fixing seat 12 is formed with a left and a right circular through holes 122.

The landing gear 2 has a fixing section 21 formed with two elongated fixing holes 22 corresponding to the through holes 122 of the fixing seat 12. The bottom face of the fixing section 21 is formed with a channel 23 perpendicular to each fixing hole 22. A slope face 24 is formed between the top edge of the fixing hole 22 and the channel 23. The slope face 24 downward turns about the axis of the fixing hole 22 from the top edge of the fixing hole 22 to the channel 23 of the bottom face of the fixing section 21.

One end of the fixing pin 3 is formed with a cap section 31 having a profile corresponding to that of the fixing hole 22. The cap section 31 extends out of the fixing hole 22. The top face of the cap section 31 is formed with a rib 311 having a profile corresponding to that of the channel 23. One end of the fixing pin 3 opposite to the cap section 31 is formed with a conic engaging section 32 having a diameter larger than the fixing pin 3. The engaging section 32 is formed with a radial cut 321. The end of the fixing pin 3 with the engaging section 32 is passed through the through hole 122 of the fixing seat 12. A spring 33 and a washer 34 are fitted between the engaging section 32 and the top face of the fixing seat 12. The upper and lower edges of the spring 33 respectively abut against the washer 34 and the top face of the fixing seat 12. The stopper edge of the washer 34 is engaged with the engaging section 32, whereby the fixing pin 3 is upward pushed by the resilient force of the spring The locating section 121 of the fixing seat 12 receives the fixing section 21 of the landing gear 2 and stops the front and rear edges of the fixing section 21. The fixing pin 3 is passed through the through hole 122 of the fixing seat 12 with the cap section 31 extending out of the fixing hole 22. Therefore, when the fixing section 21 of the landing gear 2 is placed in the locating section 121 of the fixing seat 12, the fixing section 21 is restricted and fixed by the locating section 121. At this time, the cap section 31 of the fixing pin 3 is fitted into the fixing hole 22 of the fixing section 21 as shown by the left fixing pin 3 in FIG. 3.

Figure 3:
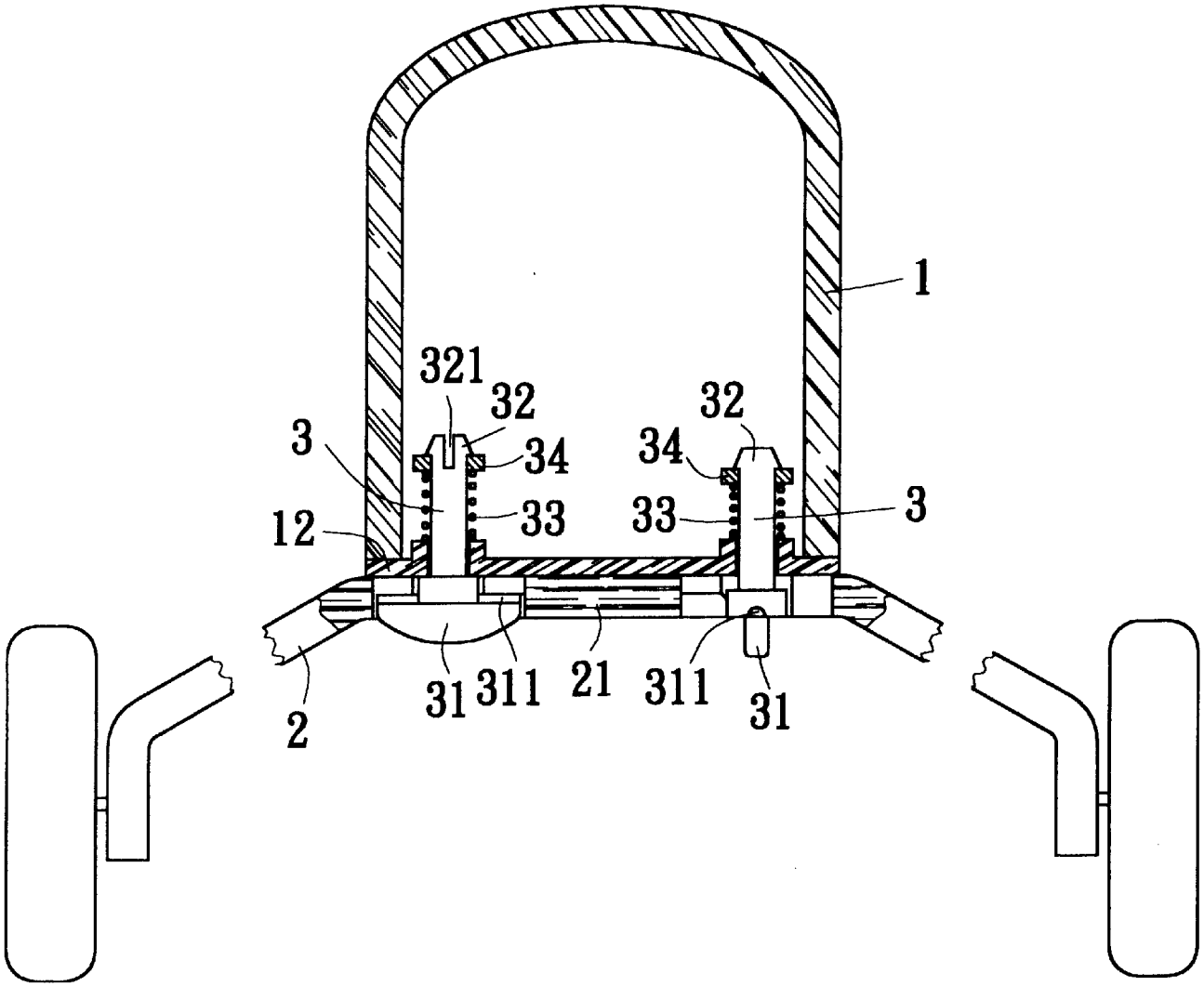
FIG. 3 is a sectional assembled view of the landing gear and landing gear fixing seat of the present invention.
Figure 4:
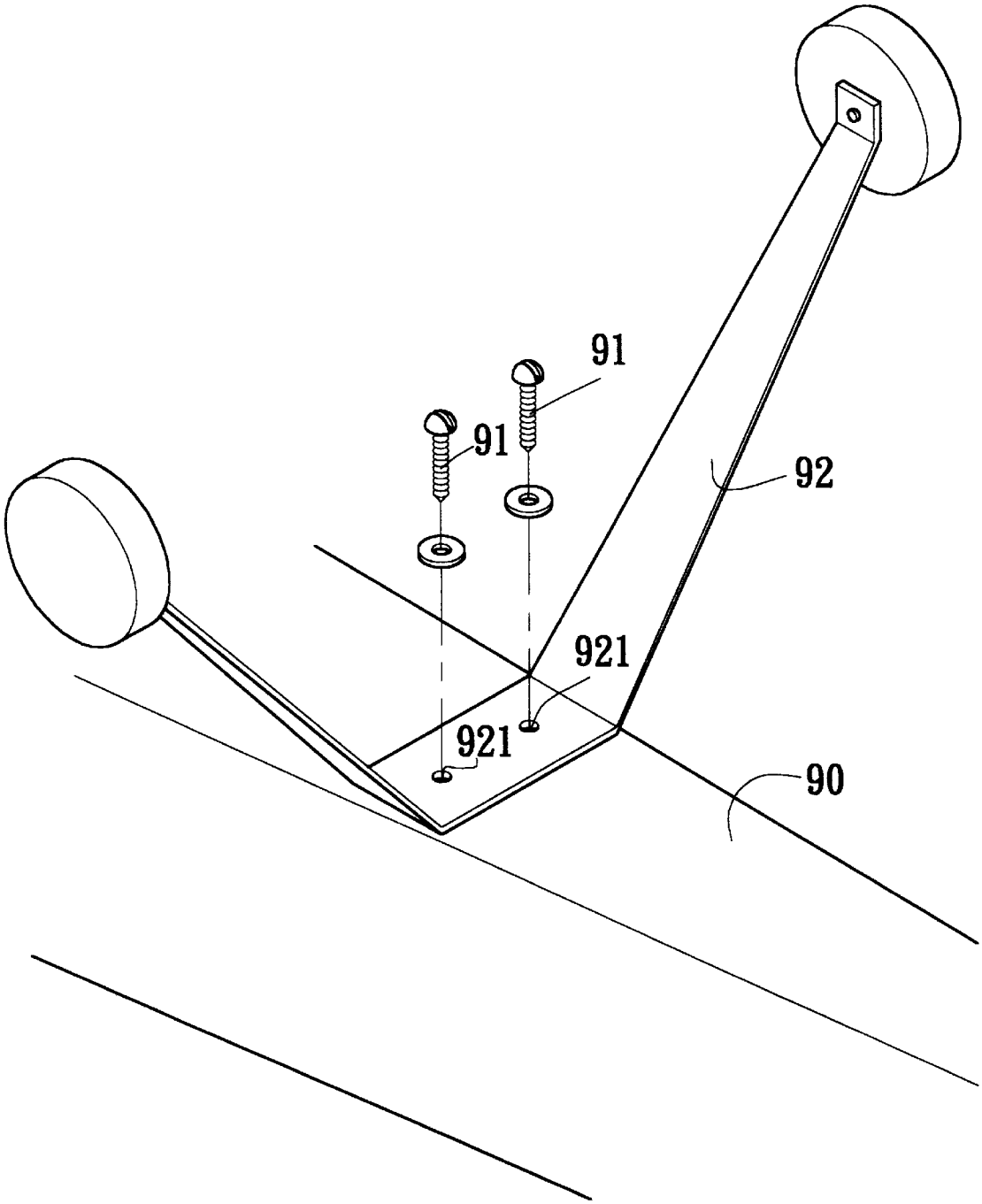
PRIOR ART FIG. 4
FIG. 4 is a perspective exploded view of the landing gear of a conventional model airplane.

Then the cap section 31 of the fixing pin 3 is pulled downward and rotated by 90 degrees along the slope face 24 to engage the rib 311 of the top face of the cap section 31 into the channel 23 of the landing gear 2 as shown by the right fixing pin 3 in FIG. 3. Then, by means of the resilient force of the spring 33 compressed between the washer 34 engaged with the engaging section 32 of the fixing pin 3 and the top face of the fixing seat 12, the washer 34 is pushed to drive the fixing pin 3 upward. Therefore, the landing gear 2 is fixed in the locating section 121 of the fixing seat 12 by the fixing pin 3.

When disassembling the landing gear 2, the cap section 31 of the fixing pin 3 is first pulled downward and then rotated by 90 degrees, making the cap section 31 of the fixing pin 3 sink into the fixing hole 22. Under such circumstance, the landing gear 2 is disengaged from the cap section 31 of the fixing pin 3 and can be taken away from the locating section 121 of the fixing seat 12 and separated from the airplane body 1.

The fixing seat 12 is made of hard wooden material or plastic material so that even though the landing gear 2 is frequently assembled and disassembled, the landing gear 2 can be still firmly fixed in the fixing seat 12. According to the above arrangement, the model airplane body 1 and the landing gear 2 can be quickly assembled and disassembled to facilitate carriage and storage of the model airplane.

The above embodiment is only used to illustrate the present invention, not intended to limit the scope thereof. Many modifications of the above embodiment can be made without departing from the spirit of the present invention.

What is claimed is:

1. An assembling structure for landing gear of a model airplane, comprising:

a hollow airplane body having a base board formed with a recess;

a landing gear fixing seat mounted in the recess of the airplane body and having a left and a right circular through holes; and a landing gear fixed on the fixing seat by fixing pins, the landing gear having a fixing section formed with two elongated fixing holes corresponding to the through holes of the fixing seat, a bottom face of the fixing section being formed with a channel perpendicular to each fixing hole, one end of the fixing pin being formed with a cap section having a profile corresponding to that of the fixing hole, the cap section extending out of the fixing hole, a top face of the cap section being formed with a rib having a profile corresponding to that of the channel, one end of the fixing pin opposite to the cap section being formed with an engaging section, the end of the fixing pin with the engaging section being passed through the through hole of the fixing seat, a resilient member being fitted between the engaging section and a top face of the fixing seat, an upper and a lower edges of the resilient member respectively abutting against the engaging section of the fixing pin and the top face of the fixing seat.

2. An assembling structure as claimed in claim 1, wherein a slope face is formed between the top edge of the fixing hole and the channel, the slope face downward turning about the axis of the fixing hole from the top edge of the fixing hole to the channel of the bottom face of the fixing section.

3. An assembling structure as claimed in claim 1, wherein the fixing seat has a locating section for stopping a front and a rear edges of the fixing section of the landing gear.

4. An assembling structure as claimed in claim 1, wherein the engaging section is conic and has a diameter larger than that of the fixing pin, the engaging section being formed with a radial cut.

5. An assembling structure as claimed in claim 1, wherein the resilient member is a spring and a washer is disposed between the spring and the engaging section of the fixing pin.

* * * * *